US007441418B2

(12) United States Patent
Delgado-Mecinas

(10) Patent No.: US 7,441,418 B2
(45) Date of Patent: Oct. 28, 2008

(54) REMODELING UNDERWEAR MANUFACTURED FROM GRADED KNIT FABRIC

(75) Inventor: Nestor Delgado-Mecinas, Naucalpan (MX)

(73) Assignee: Industries Cannon, S.A. DE C.V., Naucalpan (MX)

( * ) Notice: Subject to any disclaimer, the term of this patent is extended or adjusted under 35 U.S.C. 154(b) by 0 days.

(21) Appl. No.: 11/711,688

(22) Filed: Feb. 28, 2007

(65) Prior Publication Data

US 2007/0249265 A1 Oct. 25, 2007

(30) Foreign Application Priority Data

Mar. 9, 2006 (MX) ..... PA/A/2006/002709
Jul. 24, 2006 (MX) ..... PA/A/2006/008383

(51) Int. Cl.
*A41B 9/00* (2006.01)

(52) U.S. Cl. ..... 66/177; 66/171; 66/169 R

(58) Field of Classification Search ..... 66/8, 66/169 R, 170, 171, 175–177
See application file for complete search history.

(56) References Cited

U.S. PATENT DOCUMENTS 5,590,548 A * 1/1997 Osborne ..... 66/177
5,605,060 A * 2/1997 Osborne ..... 66/171
5,762,535 A 6/1998 Nishiyama et al.
5,787,732 A 8/1998 Perron et al.
5,823,013 A * 10/1998 Lonati et al. ..... 66/177
6,192,717 B1 * 2/2001 Rabinowicz ..... 66/177
6,287,168 B1 * 9/2001 Rabinowicz ..... 450/75
6,401,497 B1 6/2002 Nishiyama et al.
6,430,753 B2 8/2002 Duran
6,704,942 B2 3/2004 Lazarian
7,017,376 B2 3/2006 Meckley et al.
7,043,942 B2 5/2006 Chapman
2004/0006811 A1 1/2004 McKenzie

* cited by examiner

*Primary Examiner*—Danny Worrell
(74) *Attorney, Agent, or Firm*—Muncy, Geissler, Olds & Lowe, PLLC

(57) ABSTRACT

A remodeling undergarment and/or method of manufacturing a remodeling undergarment is described which includes a frontal abdominal portion configured to cover an abdominal region of a user, a lumbar portion configured to cover a lumbar region of a user, a ventral portion configured to cover a ventral region of a user, a hip portion integrally connected to the frontal abdominal portion and lumbar portion, wherein the hip portion further includes a glutei portion, including a glutei band, and a central glutei portion, configured for conforming to a user's glutei, and a first leg section and a second leg section. The abdominal portion, lumbar portion, hip portion, inner leg portions, and compression leg portions are manufactured in a single unitary piece of graded knit of at least two different yarns and knit patterns. The abdominal portion, lumbar portion and ventral portion are integrally connected together with a seamless, graded knit.

20 Claims, 4 Drawing Sheets

700

REMODELING UNDERWEAR MANUFACTURED FROM GRADED KNIT FABRIC

CROSS REFERENCE TO RELATED APPLICATIONS

This nonprovisional application claims priority under 35 U.S.C. § 119(a) on Mexican Patent Applications No. PA/a/2006/008383 and No. PA/a/2006/002709, which were filed in Mexico on Jul. 24, 2006 and Mar. 9, 2006, respectively, and which are herein incorporated by reference.

BACKGROUND

1. Field of the Disclosure

This description relates to underwear, and more particularly, relates to an undergarment knitted in substantially one piece, which forms and brings out woman's glutei through dense-knit areas, selectively defined to strategically highlight the selected areas, and to provide a notorious beauty to the woman's figure.

2. Description of Background Art

Conventional underwear containing several types of fabric in each of their parts, are typically assembled with seams. Garments made with only one fabric often do not provide adequate compression to each part of the body, or if the garments are made in one piece, the garments are round belts fitting around the body, serving as abdominal girdles. Alternatively, garments and other similar products are manufactured with several pieces of fabric which are seamed together to form the garment. For example, U.S. Pat. No. 5,762,535, the entirety of which is incorporated by reference herein, describes examples of seamed products.

SUMMARY

The aforementioned garments of the background art may include one or more of the following shortcomings. For example, the garments are relatively difficult to manufacture, as different pieces are involved which may complicate the assembly of the finished product and/or the different pieces often include various materials each having different mechanical properties. The materials used in the manufacture of the garments may also lose their properties over time and extended use, and the garment may ultimately no longer work in the desired way. If the materials are assembled with seams joining various fabrics or sections together, the seams are susceptible to wear, which may result in the seams breaking apart or loosening over time.

One or more of the garments, and/or processes of manufacturing garments described hereinafter, distinguishes the silhouette forms of each part of the feminine body and raises the glutei area, in a natural and comfortable way, with a graded compression distributed among the anatomical feminine forms. An undergarment may be manufactured seamless and splice less in the fabric, e.g., a substantially one-piece product, which offers convenience to the user without irritating the user wearing the undergarment. Accordingly, the undergarment provides comfort and naturalness to the movements of the user.

For example, an undergarment for remodeling the appearance of the feminine figure, may be knitted in one piece, e.g., without splices or seams (seamless). The undergarment may be knitted with a graduated knit in distinct areas of the garment. The undergarment may provide multiple products in one garment, e.g., an abdominal-forming underwear and fashioning corset for underbelly zone, an orthopedic garment, for correcting the user's posture, a girdle to form and accentuate the glutei, and/or a girdle to form, accentuate and naturally embellish the woman's breast.

In one general aspect, an undergarment provides for (a) flattening the belly and underbelly of the user, (b) fashioning and uprising the user's glutei, (c) supporting the user's back in order to correct her posture, and/or (d) containing, remodeling, and supporting the legs' and hip's tissues (chaps, wide hips). The remodeling garment may provide a remodeling, enhanced, and comfortable underwear, which will communicate naturalness to user's movements, by way of areas, e.g., zones of strategically selected knit, with variable mechanical properties, that are seamless and spliceless between them, and/or between strategic zones.

In another general aspect, a one-piece undergarment, with belts, provides for modeling and bringing out the woman's glutei, by way of areas of graded knit, which have different density and that are strategically defined and selected in order to raise the selected points. The undergarment may be knitted in one piece, to model and fashion the woman's figure, by way of dense or graded wave, strategically defined and selected, which overcomes the inconveniences of the abovementioned methods and garments of the background art.

A manufacturing process for producing an integral garment, with belts, which models and corrects the user's posture, may include a one-piece knitted garment, an overlapped bridge, and/or a bridge having an opening. The one-piece undergarment, having belts, models and brings out the women's glutei by way of dense-knit areas, strategically defined and selected, where at least two kinds of yarns are used, and at least two different kinds of knit pattern are used. In addition, or alternatively, a method for manufacturing the underwear knitted in one piece, for modeling and bringing out the women's glutei by way of graded-knit areas, uses tubular continuous-knit devices and/or circular machines of small diameter to knit the one-piece garment.

In one general aspect, a remodeling undergarment includes a frontal abdominal portion configured to cover an abdominal region of a user, a lumbar portion configured to cover a lumbar region of a user, a ventral portion configured to cover a ventral region of a user, a hip portion integrally connected to the frontal abdominal portion and lumbar portion, wherein the hip portion further includes a glutei portion, including a glutei band, and a central glutei portion, configured for conforming to a user's glutei, and a first leg section and a second leg section. The first leg section and the second leg section each include an inner leg portion and a compression leg portion, the first leg section and the second leg section being connected to the hips, belly and glutei portions. The abdominal portion, lumbar portion, hip portion, inner leg portions, and compression leg portions are manufactured in a single unitary piece of graded knit of at least two different yarns and knit patterns. The abdominal portion, lumbar portion and ventral portion are integrally connected together with a seamless, graded knit.

Implementations of this aspect may include one or more of the following features. For example, the abdominal portion may include a RIB knit of (a) Elastane (LYCRA™) 70/20/7 denier and (b) Nylon 1/70/68 denier, twisted yarns, and (c) Elastane 155 yarn. The lumbar portion may include a PIQUE knit of (a) Elastane (LYCRA™) 70/20/7 denier, and (b) Nylon 1/70/68 denier, twisted yarns, and (c) Elastane 155 denier yarn. The ventral portion may include a RIB HIGH knit of (a) Elastane (LYCRA™) 70/20/7 denier, and (b) Nylon 1/70/68 denier, twisted yarns. The hip portion may include a PIQUE knit of (a) Elastane 70/20/7 denier yarn and (b) Nylon 1/70/68 denier, twisted yarns. The glutei portion may include a RIB TRANSVERSAL knit of (a) Elastane 70/20/7 denier and (b) Nylon 1/70/60 deniers, twisted yarns. The glutei central portion may include a flat knit of (a) Nylon 1/70/60 denier yarn and (b) Elastane 70/20/7 denier yarn. The inner leg portion may include a flat knit of (a) Elastane 70/20/7 denier yarn, and (b) Nylon 1/70/60 yarn. The leg compression portion may include a panel knit of Elastane 70/20/7 denier and Nylon 70/60 twisted yarns.

A siliconed belt may be attached to the abdominal and lumbar portions. A suspender may be knitted integrally to the abdominal portion. The bridge may include closed bridge made of cotton, two overlapped portions, or define an opening. Elastic siliconed belts may be included at the lower end of each of the leg sections, respectively. The leg sections may be configured to extend to a user's knee or thigh.

In another general aspect, a method for the manufacture of any of the remodeling undergarments described hereinabove. At least two different types of yarn are provided in a continuous-tubular knitting machine. A design is programmed into the continuous-tubular knitting machine for manufacturing the remodeling undergarment with graded knit. The remodeling undergarment is knitted, with graded knit, and tailored.

Implementations of this aspect may include one or more of the following features. For example, tailoring may include sewing suspender sections to the undergarment. A bridge, which includes a closed bridge, an overlapped bridge, or an open bridge, is assembled.

In another general aspect, a method for the manufacture of a remodeling undergarment includes providing at least two different yarns on a continuous tubular knitting machine. A remodeling undergarment is knitted, with a graded knit of at least two yarns and at least two knit patterns, based upon a preprogrammed product design. The remodeling undergarment includes an abdominal portion, a lumbar portion, a hip portion, inner leg portions, and compression leg portions formed in a single unitary piece of graded knit of the least two different yarns and knit patterns, and the abdominal portion, lumbar portion and ventral portion are integrally connected together with a seamless, graded knit.

Other features will be apparent from the following description, including the drawings, and the claims.

DETAILED DESCRIPTION

Figure 2:
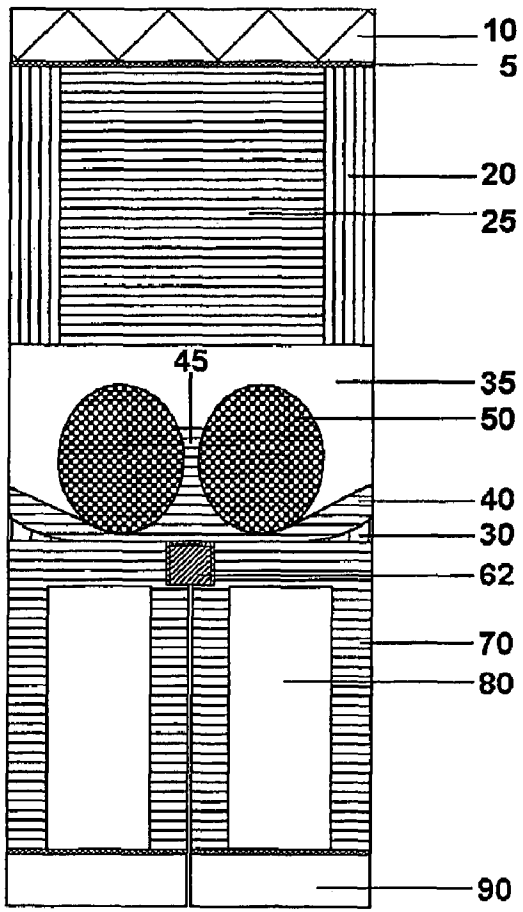
FIG. 2 is a rear view of the remodeling undergarment shown in FIG. 1, with an optional siliconed belt for fixing the upper portion.
Figure 1:
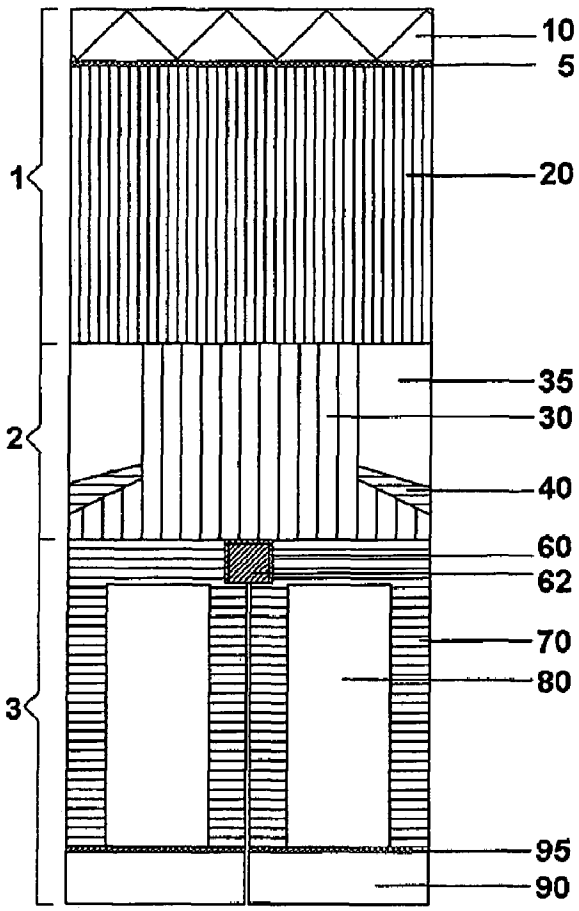
FIG. 1 is a front view of a remodeling undergarment including graded knit.

Referring to FIGS. 1 and 2, the exemplary women's underwear, which is in one piece, models and corrects the user's posture, raises the glutei with a graded and seamless knit. The undergarment includes the following zones. Specifically, the one-piece underwear includes an abdominal zone (1), a ventral (or belly)-hip zone (2) adjacent to, and just below the abdominal zone (1), and a legs' zone (3), adjacent to the ventral-hips zone (2). The abdominal zone (1) includes a graded knit having two defined parts: an abdominal part (20) and a lumbar part (25), whose purpose is to provide a support area in the lumbar zone of the user. The belly-hips zone (2) includes a frontal-belly part (30), a hip portion (35), a portion of glutei band (40) and a central portion of glutei (50). The legs' part (3) includes a portion of the bridge (60) and two trouser legs. Each trouser leg includes an inner leg portion (80) and a leg compression zone (70). The leg compression zone (70) models the chaps section of the user, and is laid in the inner and outer sides of each leg. The inner leg portion (80) embraces the front and back parts of the legs.

The abdominal portion (20) is attached, from its lateral edges, to the lumbar portion (25), which is made of high-compression knit. Both the abdominal portion (20) and the lumbar portion (25) of the back surround the user's torso, e.g., including the user's abdomen. For example, the abdominal portion (20) may include a RIB knit from (a) Elastane (LYCRA™), 70/20/7 deniers, and (b) Nylon 1/70/68 denier, twisted yarn, and (c) Elastane 155 denier yarn. However, other deniers and yarns may be used in lieu of the aforementioned yarns and deniers to provide a similar or different garment.

The lumbar portion (25) is manufactured with a combination of at least two high-compression yarns, e.g., such as Elastane (LYCRA™) 70/20/7 denier and Nylon 1/70/60 twisted yarns; and Elastane 155 denier yarn in a knit of type PIQUE, for providing a knitted zone to compress and support the user's back. The lumbar portion (25) corrects the user's posture in the dorsal-lumbar zone, and provides an erected figure of better appearance.

The abdominal zone (1) includes a lower side connected to the front belly portion (30) and to the hip portion (35) of the belly-hip zone (2). The hip portion (35) is connected to the frontal portion of the belly (30), in such a way that they both define a tubular knit intended to cover the user's hip and belly. The ventral, or belly portion (30) includes an area adequate for the ventral zone of the user. As is shown in the figures, the area has a square zone, with two opposite relatively triangular shaped lower zones, with each one of the triangular shaped lower zones extending toward the back part of the garment. However, the ventral portion (30) can cover any adequate configuration, for example, trapezoidal or rounded configuration.

The ventral zone (30) is made of high-compression yarns, and its purpose is to contain and also to flatten a user's bulky belly. For example, the ventral portion (30) may include a HIGH-RIB knit of (a) Elastane (LYCRA™) 70/20/7 deniers, and (b) Nylon 1/70/68 denier, twisted yarns. The hip portion (35) may include a PIQUE knit of (a) Elastane (LYCRA™) 70/20/7 denier, and (b) Nylon 1/70/68 twisted yarns.

The belly-hips zone (2) may also include a glutei central portion (50) and a glutei-belt portion (40) at the bottom of the glutei central portion (50). The glutei central portion (50) is made from a mild-compression yarn knit that forms a pair of pockets which fit to the user's glutei in a comfortable way. The glutei central portion (50) may include a flat knit of Nylon 1/70/68, as well as Elastane 70/20/7 deniers, that have the characteristic of being a very soft microfiber, and which offer great convenience and comfort to the user.

The glutei-belt portion (40) can be made of a high-compression knit, such as RIB TRANSVERSAL knit, of Elastane 70/20/7 denier and Nylon 1/70/68 denier, twisted yarns. The belt portion (40) extends along the glutei base during use to raise the glutei. Additionally, the belt portion (40) includes a vertical-belt segment (45) between the glutei central portions (50). The vertical-belt segment (45) forces the separation of the glutei and fashions the glutei zones adjacent to the vertical-belt segment (45). The belt portion (40) compresses the glutei base thus concentrating the glutei tissue to the center of this zone. The pockets of glutei central portions (50) offer low resistance to the concentrated glutei tissue and allow this zone to appear to "protrude" from the garment. Accordingly, while the hip portion (30) and the ventral frontal portion (30) narrow the hip and the belly, glutei are heightened and project out and up. The overall effect is the accentuation of the user's glutei volume to achieve a slender and pleasant appearance. The set of the glutei central portion (50) and the belt portion (40) form a hemispherical retention and compression surface for the adipose (fatty) tissue of the user.

The hip portion (35) substantially compresses and models the hips' tissues, thereby providing a more narrow and aesthetic conformation which generally narrows the appearance of the hips along a horizontal axis. The garment includes two leg sections, an inner leg portion (80) and a leg compression portion (70). When the garment is knitted, the leg sections form a tube which is typically trimmed in order to form each leg. Accordingly, markings are provided during the knitting stage for doing the trimming cuts of individual garments. Each leg section is a knitted extension from the body of the garment. However, the knit is separated or trimmed to form the two leg sections (70) and (80) or trouser legs. Each of the leg sections includes a leg inner portion (80), and a leg compression zone (70). The leg inner portion (80) is made of a flat knit, and preferably includes medium-compression materials. For example, the leg inner portion (80) may include a flat knit and a 70/68 denier yarn (Nylon 1/70/68 yarn) and Elastane (LYCRA™) 70/20/7 denier yarn. The leg compression portion (70) includes high-compression yarns, e.g.; such as a panel knit of Elastane 70/20/7 and Nylon 70/68 twisted yarns. The leg compression portion (70) covers the legs' area often referred to as "chaps", and the inner portion of the thighs. The leg compression portion (70) contains the abovementioned chaps, compresses and molds the thighs to provide a firm and slender appearance. Each leg section can be molded with a seam for joining the trimmed edges of each leg, such as at the inner part of the garment. The leg section may be molded with a flat knit and with 70-deniers yarns (Nylon 70/34/2). The flat knit provides a desirable combination of comfort for the user and a more discrete appearance.

Figure 4:
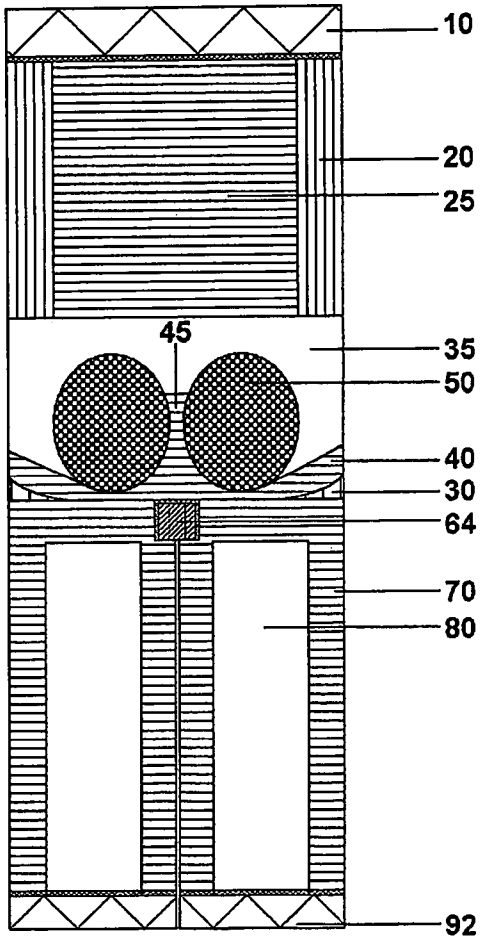
FIG. 4 is a rear view of the remodeling undergarment shown in FIG. 3.
Figure 3:
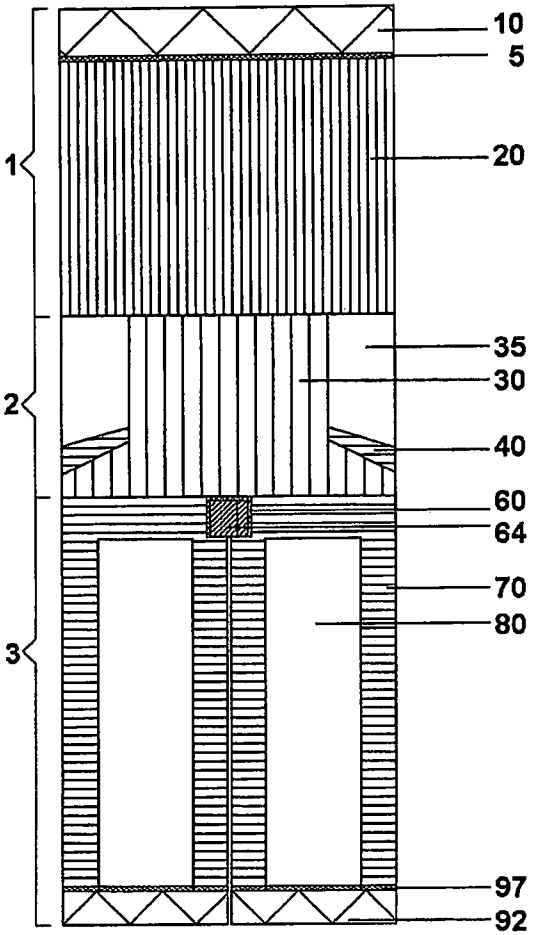
FIG. 3 is a front view of a remodeling undergarment including graded knit and having extra-long trouser legs and an overlapped bridge.
Figure 6:
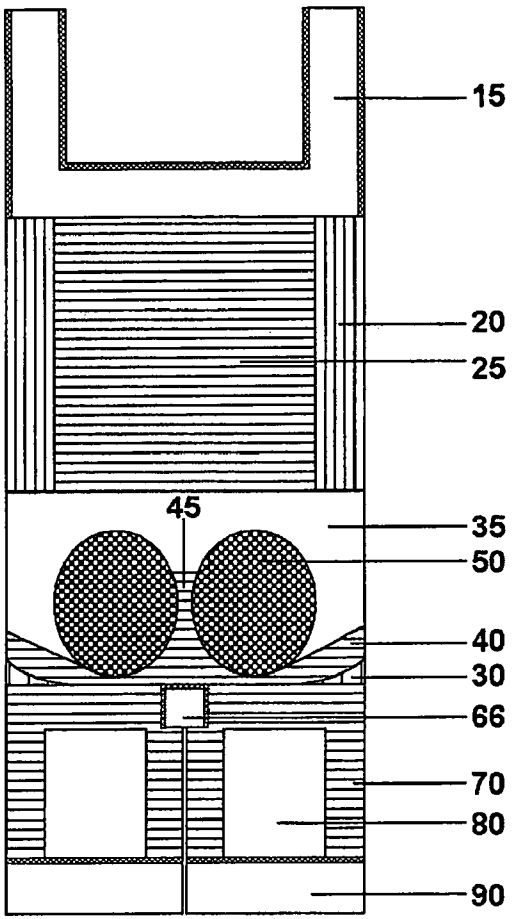
FIG. 6 is a rear view of the remodeling undergarment shown in FIG. 5.
Figure 5:
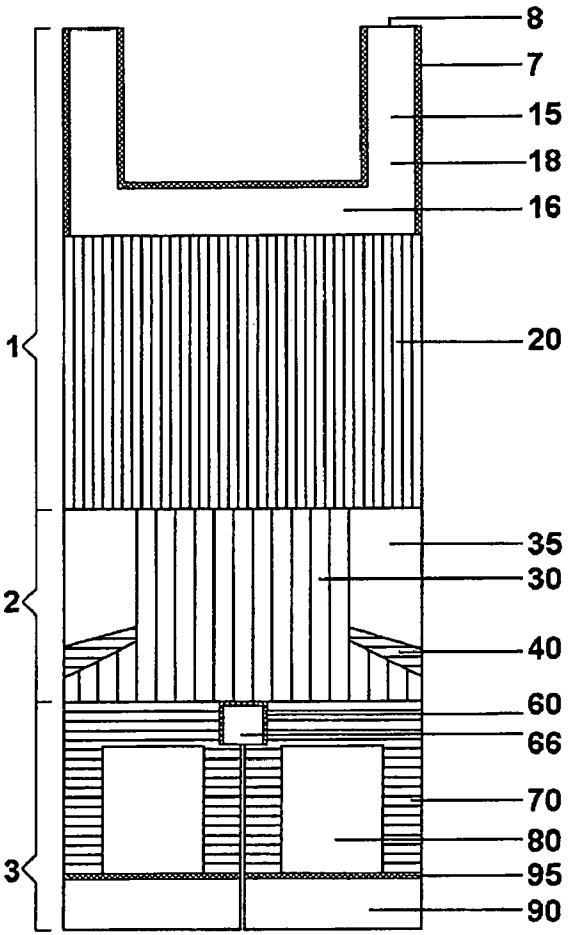
FIG. 5 is a front view of a remodeling undergarment including graded knit, a strap portion, relatively short trouser legs, and a bridge with an opening.

A bridge (60) is provided at a crotch portion of the garment. The bridge (60) is sewn to the garment with a knit. Referring to FIGS. 1 and 2, the bridge (60) can include of a cotton piece (62). Referring to FIGS. 3 and 4, an overlapped bridge (64) can be provided which includes two overlapped cotton segments. Referring to FIGS. 5 and 6, the bridge (60) includes an opening having a seam which forms the edge of the opening (66). The overlapped bridge (64) and the opening (66) function as a fly to allow the user, such as when urged by the physiological need to urinate, providing the user to open the fly without having to fully remove the underwear. For example, the bridge (64) is made of 40/1 cotton or polyamide yarn, such as commonly used to manufacture feminine underwear. A cotton anatomical bridge provides the garment with more comfort and hygiene. The anatomical bridge is designed and manufactured into the garment in order to conform to, and adhere to the user's crotch surface area, thereby enhancing and fashioning the feminine contours.

Referring to the garments of FIGS. 1-2 and 5-6, each leg section has a fabric foldup or hem (90) at the end part of each leg. All or part of the hem (90) can be made with the same material as that of the inner portion (40) base, e.g., a knit of Nylon 1/70/68 deniers and Elastane (LYCRA™) 70/20/7 deniers. The foldup or hem (90) reinforces and increases the compression force in the leg zone to control the movement of the leg portion, e.g., to prevent the leg portion from climbing up the leg while the user moves while wearing the garment, and/or from distorting the aesthetics of the feminine silhouette. Referring to FIGS. 3 and 4, an optional elastic band (97) of siliconed lace can be bonded to the garment body and/or seamed with a seam 97.

Referring to FIGS. 1-4, the trouser legs can have variable lengths, such as the relatively short trouser legs shown in FIGS. 1 and 2, which extend approximately mid-thigh on the user, and/or the relatively long trouser lengths shown in FIGS. 3 and 4 which tightly surround the thighs and extend down to the users knees. Referring to FIGS. 5 and 6, a garment is shown which includes relatively shorter lengths, even when compared to the length of the trouser legs of FIGS. 1 and 2, which extend only partially to the user's thighs.

The abdominal zone (1) includes an upper side, adjacent to an upper termination of the garment. Referring to FIGS. 1-4, the upper termination includes of a siliconed elastic band (10), which fits to the user's torso, and does not allow the garment to slip downwards. Referring to FIGS. 5 and 6, suspender straps (15) are used to maintain the garment in a desired position relative to the user's torso. The suspender (15) and/or band (10) may be used independently (as shown) or in combination, such as with the suspender (15) extending upwardly away from a horizontal band (10). For example, referring to FIGS. 5 and 6, the strap arrangement may include a strap-base portion (16) adjacent to the straps (18), e.g., both at the strap base (16) and at the straps (18). The strap arrangement may be knitted and are integral with the garment. Alternatively, or in addition, a last stitch (7) can be fixed to the strap edges to avoid unraveling of the edges and/or each strap can include an upper seam (8) for joining each suspender side (18).

Figure 7:
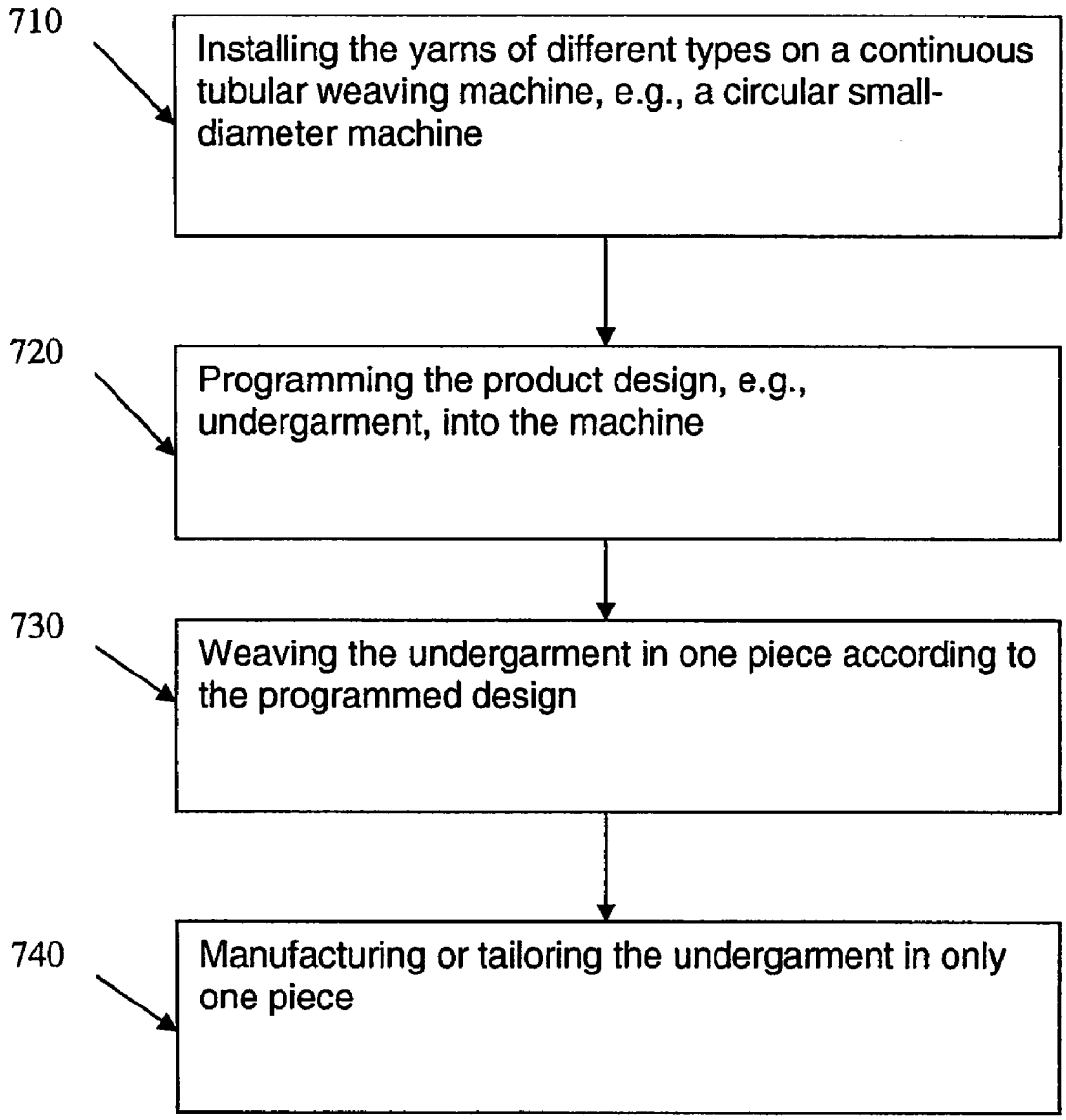
FIG. 7 is a flowchart of an exemplary process of manufacture for a remodeling undergarment.

Referring to FIG. 7, an exemplary process (700) for producing a garment includes the following a) installing the yarns of different types on a continuous tubular knitting machine, e.g., a circular small-diameter machine (710); b) programming the product design having the specific size, into the machine, strategically designed according to the different compression zones (720); c) knitting the underwear in one piece, according to the previously established design (730); and d) manufacturing the underwear in only one piece (740). Depending on the specific garment, the manufacturing may include one or more of the following processes.

For example, a remodeling corset having a siliconed belt and closed bridge may be manufactured with the following process (1.0), including trimming the legs (1.1), trimming of the bridge (1.2), sewing of the leg (1.3), cutting for the siliconed belt (1.4), closure of the siliconed belt (1.5), cutting of the chain of the siliconed belt (1.6), applying the siliconed belt (1.7), coping (1.8), and unyarning (1.9).

The trimming of the legs (1.1) may be performed with a Union Special overlock machine, e.g., without yarns or needle. The legs are cut by taking the cloth, positioning a guide (knit marking) aligned to the blades, and trimming both sides up to the change of drawing. The trimming of the bridge (1.2) may be performed with an overlock machine, e.g., without yarns or needles. The guide (knit marking) of the cloth is aligned with the trimming blade, over the bridge guide, and the bridge is formed as a rhombus. The leg is sewn (1.3) with a Yamato machine, e.g., needle type UY 118 GHS, gage 80/12, with a flat knit, ¼" wide, 6 yarns of 2/70/34 texturized yarn, neutral braiding, 18 ppp.+/−2. The rhombus-shaped bridge is applied horizontally at the back side, taking care that the bridge corner lies at the center of the trim. An after and a fore are aligned to the entrance of the turn-ups, aligning the bridge corner to the exit, leaving 5 cm of chain stitch as a coping.

The siliconed belt is cut (1.4) manually, such as with scissors. A band with a silicone application is cut to 63 cm+/−1.0 cm for small sizes, and up to 66 cm+/−1.0 cm for large or extra-large sizes. The siliconed belt (1.5) is closed with a Union Special machine, e.g., needle type UY 118 HGS gage 80/12, flat seam 6 nylon texturized 2/70/34 yarns, neutral torsion, 15 ppp+/−2. The belt splicing is closed (⅝"), with the seam centered in order to leave ¼" of the belt to the inside and to the outside of the seam. The closed belt may have measurements of approximately 30.5 cm+/−5 cm for small-medium size, and 31.5 cm+/−5 cm for large- to extra-large size. The chain the siliconed belt is cut (1.7) manually, e.g., with scissors. The chain knits are cut in the belt, e.g., leaving 5 cm in the part having escarole, e.g., as the coping, and 0.5 cm in the lower part.

The siliconed belt is applied (1.7) with a Kansai machine, e.g., needle type B63, gage 80/20; 2-needle knit, 3 texturized nylon 2/70/34 yarns, neutral torsion, 20 ppp.+/−2. The belt is sewn all around, starting at the left edge, at 3 cm from the design, aligned with the belt seam. Coping (1.8) is performed with a Brother machine, e.g., needle type DPX5 SES, gage 80/12, coping knit 42 ppc, Knit width 5/16", 2 Anefil sbx23 T-21 yarns. The garment is taken by the outer side, from the area of the seam, the chain knit is held downwards and the fastener is fixed. The operation is repeated with the other leg and with the waist, at the belt's seam. Unyarning (1.9) can be performed manually, e.g., with an unyarner. The garment is taken by the leg, and excess yarn is removed. The operation is repeated for the other leg and at the belt.

A remodeling corset having a siliconed belt and overlapped bridge may be manufactured according to the following exemplary process (2.0). The process (2.0) includes trimming of the legs (2.1), trimming of the bridge sections 2.2), splicing of the bridge sections (2.3), sewing of the leg (2.4), attaching the bridge (2.5), cutting the belt (2.6), closing the belt (2.7), cutting the chain stitch in the belt (2.8), attaching the belt (2.9), coping (2.10) and unyarning (2.11).

Trimming of the legs (2.1) can be performed with an Overlock machine Union Special, e.g., without needle or yarns. The legs are trimmed over the guide, turning around the oval, and removing the oval leaving the opening. The bridge sections are trimmed (2.2) with an Overlock machine, e.g., without yarns or needles. The guide (knit marking) on the cloth is aligned with the trimming blade on the bridge guide and the bridge is formed in rhombuses. The bridge sections are spliced (2.3) with an Overlock machine, Union Special, e.g., needles type UY 154 GHS, gage 75/11/; 3 texturized nylon 2/70/34 yarns; neutral torsion 18 PPP+/−2. The corners are trimmed at the diamond (rhombus)-shaped left side (the nylon facing upwards). The operation is repeated for the right bridge section, and the upper and lower corners are spliced and sewn with a 1 cm stitch. The leg is sewn (2.4) with a Yamato machine, e.g., needle type UY 118 GHS Gage 80/12; and Flat seam, Seam width ¼", 6 texturized nylon 2/70/34 yarns, neutral torsion. 18 ppp+/−2. The garment is taken by the forward and backward side, the entrance is aligned and the fabric is spliced, leaving 8.5 cm without sewing (before arriving at the end of the cut), for attaching the bridge sections.

The bridge is attached (2.5) with an Overlock machine, Union Special; needle type UY 154 GHS, Gage 75/11; 3 texturized 2/70/34 nylon yarns, neutral torsion 18 PPP+/−2. The bridge is vertically sewn, the left side is attached, giving the bridge a rhombus shape, and then the right side is attached. The belt is cut (2.6), with silicone application, to 63 cm for small- and medium sizes, and to 66 cm for large- and extra-large sizes, e.g., tolerances of +/−1 cm. The belt is closed (2.7) with a Union Special machine, e.g., needle type UY 118 GHS gage 80/12, and Flat seam, 6 texturized 2/70/34 nylon yarns, neutral torsion, 15 ppp.+/−2. The seam is centered, in order to leave ¼" of the belt to the inside and to the outside of the seam, and the belt is closed with splicing (⅝"). The belt may measure approximately 30.5 cm for small- and medium sizes, and approximately 31.5 cm for large- and extra-large sizes. The chain stitch in the belt is cut (2.8) manually, with scissors. At the part of the scarole, approximately 5 cm of chain is left for coping, and 0.5 cm is left at the lower part.

The attachment of the belt (2.9) is performed with a Kansai machine, e.g., needle type B63; Gage 80/20; and 2-needle seam, 3 texturized 2/70/34 nylon yarns, neutral torsion, 20 ppp.+/−2. The belt is sewn, starting at the left edge, at 3 cm from the design, and aligned with the belt seam with which the belt is sewn around. Coping (2.10) is performed with a Brother machine, e.g., needle type; DPX5 SES, gage 80/12; coping stitch, 42 PPC; seam width: 5/16"; two Anefil sbx23 T-21 yarns. The garment is positioned by the outer side, from the seam zone, and the chain stitch is held downwards. The clip is attached and the operation is repeated at the other leg, and at the waist, at the attachment of the belt. Unyarning (2.11) is performed manually, e.g., using an unyarner. The garment is positioned with the leg, the excess yarn is removed, and the operation is repeated with the other leg and with the belt.

An exemplary process (3.0) for manufacturing a remodeling corset with a siliconed belt, and bridge with an opening includes trimming of the legs (3.1), sewing the leg (3.2), cutting the siliconed belt (3.3), closing the siliconed belt (3.4), cutting the chain stitch at the siliconed belt (3.5), attaching the siliconed belt (3.6), coping (3.7), and unyarning.

Trimming of the legs (3.1) can be performed with an Overlock machine, Union Special, e.g., without yarns nor needle. The legs are trimmed, over the guide, turning around the oval, and detaching the oval leaving the opening. The leg is sewn (3.2) with a Yamato machine, e.g., needle type UY 118 GHS, gage 80/12; Flat seam, ¼" width; 6 texturized nylon 2/70/34 yarns with neutral torsion, 18 ppp+/−2. A seam at the back is made, where the oval was, and followed by one fore and one aft, aligning the upturns' entrance, watching that the ovals coincide, to leave an opening, e.g., measuring approximately 13.5 cm long by 7 cm wide. The siliconed belt is cut (3.3) with a silicone application, e.g., approximately 63 cm for small- and medium sizes, and 66 cm for large- and extra-large sizes. Tolerance+/−1.0 cm.

The silicone belt is closed (3.4) with a Union Special machine, e.g., UY 118 GHS, Gage 80/12; and Flat seam, 6 texturized 2/70/34 nylon yarns, neutral torsion, 15 ppp+/−2. Closing includes splicing ⅝", where the seam is centered in order to leave ¼" of belt to the inside and to the outside of the seam. The closed belt is measured to verify approximately 30.5 cm for small- and medium sizes, and 31.5 cm+/−0.5 cm for large- and extra-large sizes; tolerance: +/−1.0 cm. The chain stitch is cut at the siliconed belt (3.5) manually, e.g., with scissors. At the scarole zone, approximately 5 cm of chain is left for coping, and 0.5 cm is left at the bottom part.

The siliconed belt is attached (3.6) with a Kansai machine, e.g., needle type B63, gage 80/20; 2-needle stitch, 3 texturized nylon 2/70/34 yarns, of neutral torsion, 20 ppp+/−2. Starting at the left edge, approximately 3 cm from the design, the belt is sewn around while aligned with the belt stitch. Coping (3.7) is performed with a Brother machine; needle type DPX5 SES, gage 80/12; and coping stitch 42 PPC, seam width 5/16". 2 Anefil sbx23 T-21 yarns. The garment is positioned by the outer side of the seam, while holding the chain stitch downwards and the fastener is attached. The operation is repeated at the other leg and at the waist, e.g., at the belt splice. Unyarning is performed manually, e.g., with an unyarner by taking the garment by the leg, cutting away the surplus yarn, and repeating the operation for the other leg and for the belt.

A remodeling corset with suspenders and closed bridge is manufactured by the following exemplary process (4.0). The process (4.0) includes trimming and fixing elastic bands to the suspenders (4.1), closure of the suspender shoulders (4.2), hemming of the suspenders (4.3), trimming the legs (4.4), trimming the bridge (4.5), sewing the leg (4.6), coping (4.7), and unyarning (4.8).

Trimming and fixing of the elastic bands to the suspenders (4.1) is performed with a Kansay machine (over elastic), e.g., needle type DCX1, gage 80/12; and 3 texturized nylon 2/70/34 yarns. Neutral torsion 18 PPP+/−2. 0.7 cm elastic. The elastic band is trimmed and attached at the same time, starting at the low neckline and end at the neck, eventually at the two darts. The suspender shoulders are closed (4.2) with an Overlock machine, Union Special, e.g., needle type UY 154 GHS gage 75/11; and 3 texturized nylon 2/70/34 yarns; neutral torsion 18 PPP+/−2. The shoulders are closed up to the guide. The suspenders are hemmed (4.3) with a Kansai (Hemmer), e.g., needle type B63, gage 80/12; and 2-needle stitch, 3 Texturized nylon 2/70/34 yarns; neutral torsion 18 PPP+−2. The hem is applied at the low neckline and at the neck, starting from the left suspender, in the over seam, and hemmed up to the starting point. The operation is repeated at the other two darts.

The legs are trimmed (4.4) with an Overlock machine, Union Special, e.g., without yarns or needle. The cuts are made by positioning the fabric, positioning the guide (knit marking) aligned with the blades, and trimming up to the change of design, both sides. The bridges are trimmed (4.5) with an Overlock machine, e.g., with yarn nor needles. The cloth for the bridge is positioned so the guide (knit marking) is aligned to the trimming blade, and over the bridge guide. The bridge is shaped in a diamond or rhombic shape.

The legs are sewn (4.6) with a Yamato machine, e.g., needle type UY 118 GHS, gage 80/12; and Flat seam, ¼" wide; 6 texturized nylon 2/70/34 yarns, neutral torsion, 18 ppp.+/−2. The rhombic bridge is applied horizontally at the back side, taking care that the corner of the bridge lies at the center of the cut; then a back and a fore are taken, aligning the entrance of the hems. The bridge corner is positioned to the center of the cut, the hems are aligned at the exit, and approximately 5 cm of chain stitch are left as coping.

Coping (4.7) is performed with a Brother machine, e.g., needle type DPX5 SES gage 80/12; and coping seam 42 PPC. Seam width 5/16"; 2 Anefil sbx23 T-21 yarns. The garment is taken by the outer side, by the attachment zone. The chain stitch is held downwards and a snap fastener is attached. The operation is repeated for the other leg. Unyarning (4.8) is performed manually with an unyarner. The first leg is positioned and the excess yarn is cut. The operation is repeated for the other leg.

An exemplary process (5.0) for manufacturing a remodeling corset with suspenders and an overlapped bridge includes trimming and applying stretch to the suspenders (5.1), closing the suspender shoulders (5.2), hemming the suspenders (5.3), trimming the legs (5.4), trimming the bridge (5.5), attaching the bridge (5.6), sewing the leg (5.7), attaching the bridge (5.8), coping (5.9), and unyarning (5.10).

Trimming and applying stretch to the suspenders (5.1) is performed with a Kansai machine (over stretcher), e.g., needle type DCX1. Gage 80/12; 3 texturized nylon 2/70/34 yarns, neutral torsion 18 PPP+/−2, 0.7 cm welt. The suspenders are trimmed and simultaneously the welt is applied, starting with the low neck and end at the neck, finally at the two darts. The suspender shoulders are closed (5.2) with an Overlock machine, Union Special; e.g., needle type UY 154 GHS, Gage 75/11; and 3 texturized nylon 2/70/34 yarns, neutral torsion 18 PPP+/−2. The shoulders are closed up to the guide.

The suspenders are hemmed (5.3) with a Kansai (hemmer) machine; e.g., needle type B63; gage 80/12; and 2-needle stitch, 3 texturized nylon 2/70/34 yarns. Neutral torsion 18 PPP+/−2. The hems are applied at the low neck and the neck, starting at the left suspender, in the over knit, and hem up until arriving to the start point. The operation is repeated with the two darts. The legs are trimmed (5.4) with an Overlock machine, Union Special, e.g., without needle nor yarns. The legs are trimmed, over the guide, e.g., surrounding the oval and removing the oval leaving the opening.

The bridge is trimmed (5.5) with an Overlock machine, e.g., without yarns nor needle. The guide (knit marking) is positioned, aligned with the trimming blade, over the bridge guide and the bridge is cut with a rhombic shape. The bridges are attached (5.6) with an Overlock machine, Union Special, e.g., needle type UY 154 GHS, gage 75/11; and 3 texturized nylon 2/70/34 yarns, neutral torsion. 18 ppp+/−2. The left corner, diamond-shaped bridge is trimmed (nylon side facing upwards). The operation is repeated on the other bridge, e.g., the right side. The upper and lower corners are spliced and sewn with a 1 cm seam. The leg is sewn (5.7) with a Yamato machine, e.g., needle type UY 118 GHS Gage 80&12; and Flat knit. Seam width: ¼", 6 texturized nylon 2/70/34 yarns, neutral torsion. 18 ppp+/−2. The leg is positioned from the fore- and back side, the entrance is aligned and the fabric is joined, leaving 8.5 cm without sewing (before arriving to the end of the cut) for attaching the bridge.

The bridge is attached (5.8), with an overlock machine, Union Special, e.g., needle type UY 154 GHS gage 75/11; and 3 texturized nylon 2/70/34 yarns. 18 ppp+/−2. The bridge is sewn vertically, the left side is joined, thereby providing a rhombic shape. The right side is then joined. Coping (5.9) is performed with a Brother machine, e.g., needle type DPX5 SES. Gage 80/12; and coping knit 42 PPC; seam width 5/16", 2 Anefil stx23 T-21 yarns. The garment is taken from the outer side, at the attachment zone, and the chain knit is held downwards and the operation above is repeated at the other leg. Unyarning (5.10) is performed manually, e.g., with an unyarner by taking the garment by the leg, removing the surplus yarn, and repeating the same with the other leg.

An exemplary process for manufacturing a remodeling corset with suspender and an opening bridge includes trimming and attachment of the elastic to the suspenders (6.1), closing the suspender shoulders (6.2), hemming the suspenders (6.3), trimming the legs (6.4), sewing the leg (6.5), coping (6.6), and unyarning (6.7).

Trimming and attachment of elastic to the suspenders (6.1) is performed with a Kansai (over, stretcher); e.g., needle type DCX1, Gage 80/12; and 3 texturized 2/70/34 nylon yarns; neutral torsion 18 PPP+/−2, and 0.7 cm elastic band. The suspender is trimmed and the elastic is attached to the suspender, starting from the low neck and ending at the neck, and finally to the two darts. The suspender shoulders are closed (6.2) with an Overlock machine, Union Special; e.g., needle type UY 154 GHS, Gage 75/11; and 3 texturized nylon 2/70/34 yarns, neutral torsion 18 PPP+/−2. The shoulders are closed to the guide.

The suspenders are hemmed (6.3) with a Kansai (hemmer) machine, e.g., needle type B63, gage 80/12; and sewing with 2 needles, 3 texturized nylon 2/70/34 yarns, neutral torsion, 18 PPP+/−2. The hemming is attached to the low neck and to the neck, starting from the left suspender, in the over seam, and hemmed up to the starting point. The operation is repeated with the two darts. The legs are trimmed (6.4) with an Overlock machine, Union Special, e.g., without needle nor yarns. The legs are trimmed, over the guide, around the oval, and by detaching the oval to leave the opening.

The legs are sewn (6.5) with a Yamato machine, e.g., needle type UY 118 GHS Gage 80/12; and Flat knit, ¼" wide, 6 texturized nylon 2/70/34 yarns, neutral torsion, 18 ppp.+/−2. The legs are sewn at the back side, where the oval was, and followed by a fore and an aft. The legs are aligned with the hem entrances, taking care that the ovals match, to leave an opening with 13.0 cm long and 7 cm wide. Coping (6.6) is performed with a Brother machine, e.g., needle type DPX5 SES, gage 80/12; and coping stitch 42 PPC, Width of the seam 5/16" 2 Anefil stx23 T-21 yarns. The garment is taken from the outer side, by the joining zone, and the chain stitch is held downwards. The fastener is applied and the operation is repeated for the other leg. Unyarning (6.7) is performed manually with an unyarner by taking the garment by the leg, removing the surplus yarn, and repeating the operation for the other leg.

The undergarment may include a knit and/or tailoring as described in the following table:

| | |
|---|---|
| KNIT | |
| Nylon yarn | 1/70/68 |
| LYCRA ™ yarn | 70/20/7 |
| Elastane yarn | ELASTANE, 155 denier. |
| Cotton yarn | 40/1 |
| TAILORING | |
| Nylon yarn | 70/34/2 |
| Polyester | White, black or crude |

However, the undergarment can be manufactured using yarns of different deniers than those indicated in order to vary the denier in various locations or zones. The garment can be manufactured in different colors, e.g., preferably white, black and crude (flesh). The dimensions of an exemplary garment, according to the sizes, are shown in the following Table.

Dimensions' table

| | DESCRIPTION | SIZES S | M | L | XL | TOLERANCE |
|---|---|---|---|---|---|---|
| A | FRONT LENGTH | | | | | |
| | KNIT | 50 | 54 | 57 | 60 | +−0.5 cm |
| | COPING | 51 | 52 | 54 | 56 | |
| B | HIND LENGTH | | | | | |
| | KNIT | 56 | 60 | 63 | 65 | +−0.5 cm |
| | COPING | 53 | 55 | 57 | 58 | |

-continued

Dimensions' table

| | DESCRIPTION | SIZES S | M | L | XL | TOLERANCE |
|---|---|---|---|---|---|---|
| C | WAIST LENGTH | | | | | |
| | KNIT | 16 | 18 | 19 | 19 | +−0.5 cm |
| | COPING | 14 | 15 | 16 | 17 | |
| D | WAIST WIDTH | | | | | |
| | KNIT | 28 | 28 | 29 | 29 | +−0.5 cm |
| | COPING | 21 | 21 | 22 | 22 | |
| E | LEG LENGTH | | | | | |
| | KNIT | 15.5 | 16 | 16.5 | 17.5 | +−0.5 cm |
| | COPING | 13 | 13 | 14 | 14.5 | |
| F | LEG WIDTH | | | | | |
| | KNIT | 18 | 18.5 | 18.5 | 18.5 | +−0.5 cm |
| | COPING | 15 | 15 | 15 | 15 | |
| G | GLUTEUS LENGTH | | | | | |
| | KNIT | 16 | 16 | 17 | 18 | +/−0.5 cm |
| | COPING | 14 | 15 | 16 | 17 | |
| H | GLUTEUS WIDTH | | | | | |
| | KNIT | 11.5 | 12 | 12 | 12 | +/−0.5 cm |
| | COPING | 10 | 10 | 10 | 10 | |
| I | HEM WIDTH | | | | | |
| | KNIT | 36 | 36 | 37 | 37 | +/−0.5 cm |
| J | HEM LENGTH | | | | | |
| | KNIT | 5 | 5 | 5 | 5 | +/−0.5 cm |
| | COPING | 4.5 | 4.5 | 4.5 | 4.5 | |
| K | TOTAL LENGTH | | | | | +/−0.5 cm |
| | FRONT COPING | 50 | 52 | 54 | 55 | |
| | BACK COPING | 52 | 54 | 56 | 58 | |
| L | ELASTICITY | | | | | +/−0.5 cm |
| | KNIT | 93 | 93 | 95 | 95 | |

Although different garment zones are illustrated in the accompanying drawings, as has been described, the garment is made in a single piece, in such a way that the knit is continuous and as a unitary piece throughout the garment's length. Although different zones are not noticeable to the eye, by applying tension to the different garment zones, it will be appreciated that the garment includes different zones, each with different mechanical and textile properties. Alternatively, or in addition, the garment may be directed at undergarments for men, e.g., without incorporating chaps and/or otherwise adapted to the masculine anatomy.

One or more of the foregoing, one-piece undergarments, models and brings out the women's glutei, through dense-knit in strategically defined and selected areas. The undergarment is one-piece, has belts, and does not have lateral seams nor splices between selected and strategic zones, such as extending between the legs of the user either horizontally or vertically, which can hurt or irritate the body. The undergarment may include compression zones defined by the strategic zones which include the garment, and which are devoted to each zone conforming to feminine body. The edge technology used allows the necessary adjustment between each part, and also the combination of different types of yarns, in order to grade the garment's compression. The garment is manufactured for sizes and with different yarn deniers, in order to give the garment the necessary compression for its conformation. The garment uses at least two different kinds of yarns, and at least two different patterns of knit. However, more or less yarns may be used depending upon the application.

One or more of the foregoing undergarments provides remodeling underwear which provides comfort, fashionable fit, and heightening of the glutei's zones, which previously has been achieved with several different and separate garments. The garment may be manufactured with a knitted tubular base, preferably made of Nylon 1/70/60 yarn, having the feature of being a very soft and comfortable micro-fiber, thus being very comfortable. While the garment is being knitted, other yarns are incorporated to the knit, in order to provide zones of less flexibility, which in use provide the remodeling properties desired by the user. The zones may include zones of intermediate compression, where twisted Elastane (LYCRA™) 70/20/7 is incorporated, as well as high-compression zones where twisted Elastane (LYCRA™) 70/20/7 denier yarn (twisted with Nylon 1/70/68 denier yarn) and Elastane 155 denier-yarn are incorporated.

One or more of the foregoing methods and/processes described in connection with the embodiments described herein may be embodied directly in hardware, in a software module executed by a processor, or in a combination of the two. A software module may reside in RAM memory, flash memory, ROM memory, EPROM memory, EEPROM memory, registers, hard disk, a removable disk, a CD-ROM, or any other form of storage medium known in the art. An exemplary storage medium is coupled to a processor controlling operation of a machine, such as a tubular knitting machine, such that the processor can read information from, and write information to, the storage medium.

Although detailed embodiments and implementations have been described above, it should be apparent that various modifications are possible without departing from the spirit and scope of the present invention.

What is claimed is:

1. A remodeling undergarment comprising:

a frontal abdominal portion configured to cover an abdominal region of a user;

a lumbar portion configured to cover a lumbar region of a user;

a ventral portion configured to cover a ventral region of a user;

a hip portion integrally connected to the frontal abdominal portion and lumbar portion, wherein the hip portion further comprises:

a glutei portion, including a glutei band, and a central glutei portion, configured for conforming to a user's glutei; and a first leg section and a second leg section, wherein the first leg section and the second leg section each include an inner leg portion and a compression leg portion, the first leg section and the second leg section being connected to the hips, belly and glutei portions;

wherein the abdominal portion, lumbar portion, hip portion, inner leg portions, and compression leg portions are manufactured in a single unitary piece of graded knit of at least two different yarns and knit patterns, and the abdominal portion, lumbar portion and ventral portion are integrally connected together with a seamless, graded knit.

2. The remodeling undergarment of claim 1, wherein the abdominal portion comprises a RIB knit of (a) Elastane (LYCRA™) yarn, 70/20/7 denier, and (b) Nylon 1/70/68 denier, twisted yarn, and (c) Elastane 155 denier yarn.

3. The remodeling undergarment of claim 2, wherein the lumbar portion comprises a PIQUE knit of (a) Elastane (LYCRA™) yarn, 70/20/7 denier, and (b) Nylon 1/70/68 denier, twisted yarn, and (c) Elastane 155 denier yarn.

4. The remodeling undergarment of claim 3, wherein the ventral portion comprises a RIB HIGH knit of (a) Elastane (LYCRA™) yarn, 70/20/7 denier, and (b) Nylon 1/70/68 denier, twisted yarn.

5. The remodeling undergarment of claim 4, wherein the hip portion comprises a PIQUE knit of (a) Elastane (LYCRA™) yarn, 70/20/7 denier, and (b) Nylon 1/70/68 denier, twisted yarn.

6. The remodeling underwear of claim 5, wherein the glutei portion comprises a RIB TRANSVERSAL knit of (a) Elastane 70/20/7 denier and (b) Nylon 1/70/60 denier, twisted yarn.

7. The remodeling undergarment of claim 5, wherein the glutei central portion comprises a flat knit of Nylon 1/70/60 denier yarn and Elastane 70/20/7 deniers yarn.

8. The remodeling undergarment of claim 5, wherein the inner leg portion comprises a flat knit on Nylon 1/70/60 denier yarn, and Elastane 70/20/7 denier yarn.

9. The remodeling undergarment of claim 5, wherein the leg compression portion comprises a panel knit of Elastane 70/20/7 denier and Nylon 1/70/60 denier, twisted yarns.

10. The remodeling undergarment of claim 1, further comprising a siliconed belt attached to the abdominal and lumbar portions.

11. The remodeling undergarment of claim 1, further comprising a suspender knitted integrally to the abdominal portion.

12. The remodeling undergarment of claim 1, further comprising a bridge portion, wherein the bridge comprises a closed bridge made of cotton.

13. The remodeling undergarment of claim 12, wherein the bridge comprises two overlapped portions.

14. The remodeling undergarment of claim 12, wherein the bridge defines an opening.

15. The remodeling undergarment of claim 1, further comprising elastic siliconed belts at the lower end of each of the leg sections, respectively.

16. The remodeling undergarment of claim 1, wherein the leg section are configured to extend to a user's knee or thigh.

17. A method for the manufacture of a remodeling undergarment, the method comprising:

a) providing at least two different types of yarn in a continuous-tubular machine;

b) programming a design into the continuous-tubular knitting machine for manufacturing the remodeling undergarment with graded knit according to claim 1;

c) knitting, with graded knit, the remodeling undergarment according to claim 1; and d) tailoring the knitted undergarment.

18. The method of claim 17, wherein tailoring comprises sewing suspender sections.

19. The method of claim 17, comprising assembling a bridge, wherein the bridge comprises a closed bridge, an overlapped bridge, or an open bridge.

20. A method for the manufacture of a remodeling undergarment, the method comprising:

providing at least two different yarns on a continuous tubular knitting machine; and knitting, with a graded knit of at least two yarns and at least two knit patterns, a remodeling undergarment based upon a preprogrammed product design, wherein the remodeling undergarment includes an abdominal portion, a lumbar portion, a hip portion, inner leg portions, and compression leg portions formed in a single unitary piece of graded knit of the least two different yarns and knit patterns, and the abdominal portion, lumbar portion and ventral portion are integrally connected together with a seamless, graded knit.

* * * * *